US009610796B2

(12) United States Patent
Wong

(10) Patent No.: US 9,610,796 B2
(45) Date of Patent: Apr. 4, 2017

(54) LOOSE-LEAF FOLDER DEVICE

(71) Applicant: Angel Hoi Ling Wong, Hong Kong (HK)

(72) Inventor: Angel Hoi Ling Wong, Hong Kong (HK)

( * ) Notice: Subject to any disclaimer, the term of this patent is extended or adjusted under 35 U.S.C. 154(b) by 46 days.

(21) Appl. No.: 14/720,966

(22) Filed: May 25, 2015

(65) Prior Publication Data

US 2015/0336417 A1 Nov. 26, 2015

(30) Foreign Application Priority Data

May 26, 2014 (CN) ..... 2014 1 0225559

(51) Int. Cl.

| | |
|---|---|
| ***B42F 13/16*** | (2006.01) |
| ***B42F 13/18*** | (2006.01) |
| ***B42F 13/00*** | (2006.01) |
| ***B42F 13/22*** | (2006.01) |

(52) U.S. Cl.

CPC ..... *B42F 13/18* (2013.01); *B42F 13/0033* (2013.01); *B42F 13/16* (2013.01); *B42F 13/22* (2013.01)

(58) Field of Classification Search

CPC ..... B42F 13/16; B42F 13/18
USPC ..... 402/4, 27, 43, 50, 55, 56, 58
See application file for complete search history.

(56) References Cited

U.S. PATENT DOCUMENTS

| | | | | |
|---|---|---|---|---|
| 3,032,040 | A * | 5/1962 | Wakeman | B42F 13/12 402/60 |
| 3,453,060 | A * | 7/1969 | Caudle | B42F 13/20 402/45 |
| 3,833,308 | A * | 9/1974 | Seaborn | B42F 13/18 402/56 |
| 4,733,985 | A * | 3/1988 | Moosmuller | B42F 13/16 402/27 |
| 5,692,848 | A * | 12/1997 | Wada | B42F 13/26 281/27.1 |
| 5,716,153 | A * | 2/1998 | Aiello | B42F 13/26 402/46 |
| 2006/0104708 | A1* | 5/2006 | Kaneda | B42F 13/26 402/46 |
| 2012/0170968 | A1* | 7/2012 | Henderson | B42F 13/18 402/36 |

FOREIGN PATENT DOCUMENTS

| | | | | |
|---|---|---|---|---|
| WO | WO 2006017467 | A2 * | 2/2006 | B42F 13/24 |

* cited by examiner

*Primary Examiner* — Kyle Grabowski

(74) *Attorney, Agent, or Firm* — Howard IP Law Office, PA; Jeremy Howard

(57) ABSTRACT

A loose-leaf folder device includes a pair of main components. First half retaining rings and second half retaining rings are arranged on the housing of the main components. Two main components can be combined with or separated from each other. When combined together, the first half retaining ring can be combined with the first half retaining ring of the other main component to form a closed retaining ring to retain loose-leaf paper. When separated from each other, the main component along with loose-leaf paper retained by it can be separated from the other main component to form two independent parts. The second half retaining ring on the housing can rotate and can form a closed retaining ring with the corresponding first half retaining ring to retain loose-leaf paper.

20 Claims, 4 Drawing Sheets

LOOSE-LEAF FOLDER DEVICE

The present application claims priority from Chinese Application No. 201410225559.4, filed on May 26, 2014, the entire disclosure of which is incorporated herein by reference.

BACKGROUND

1. Field of the Invention

The present disclosure relates to a loose-leaf folder, and in particular to a loose-leaf folder device with separation and recombination function.

2. Relevant Background

In today's technology-driven society, the physical recording and storing of information are becoming more digitalized. Although digitization of information is generally considered more environmentally-friendly and easier to store and share, there still exists a major setback in functionality and user experience. When a user wants to review and compare different pages of the same file on an electronic device simultaneously, or compare separate files respectively in a side-by-side view, the user's reading is usually limited by the screen size and the system operation of the electronic device. In addition, reviewing content on an electronic device for an extended period of time, which is common for important information, can cause discomfort and strain to the reader's eyes. Therefore, many people still prefer using traditional loose-leaf folders to review and store articles, paper documents, or the like.

Traditional loose-leaf folders have many models. For the popular loose-leaf ring folder, a retaining ring device is arranged in the middle position, so loose-leaf paper can be inserted into or drawn out when the retaining ring device is open, and when the retaining ring device is closed, loose-leaf paper is bound and the page order fixed in the folder. Although this characteristic allows a user to organize and store material, in terms of reviewing and comparing material in a flexible manner, traditional loose-leaf folders still lack the core functionality in allowing users to review and compare different, nonconsecutive loose-leaf pages in a folder simultaneously in a side-by-side view.

Specifically, if a user wishes to compare different loose-leaf pages when the traditional folder's retaining ring device is closed, for example, to compare pages 3 and 19, the user would likely need to flip back and forth between the two pages, as the user cannot review two nonconsecutive pages at the same time. Therefore, one approach is opening the retaining ring device of the loose-leaf folder, drawing out one page, closing the retaining ring device, turning to the other corresponding page to perform a side-by-side view comparison, then inserting back the drawn page to the loose-leaf folder. Such approach commonly requires the user to notice or mark the position of the drawn loose-leaf page in advance, to prevent the loose-leaf folder from losing sequential order when inserting back the drawn loose-leaf page after comparison.

Another common comparison method is drawing out partial sections consisting of stack of paper from the loose-leaf folder entirely, reviewing and comparing unbounded pages individually, then inserting the drawn loose-leaf pages back to the loose-leaf folder entirely. However, such method requires the user to maintain the order of the whole stack of loose-leaf pages when the loose-leaf pages are unbound. In addition, if the whole stack of loose-leaf pages has a certain degree of thickness, the positioning of the punched hole of individual loose-leaf pages can easily become irregular as a paper stack, especially when certain loose-leaf pages within the stack are manually hole-punched resulting in non-uniformed positioning of the sheet holes. As such, inserting loose-leaf paper stack with non-uniformed positioning of sheet holes back to the retaining ring device could lead to possible tearing and damage of loose-leaf sheet holes.

SUMMARY

The objective of the present invention is to provide a loose-leaf folder device with separation and recombination functions allowing a user to review and compare different, nonconsecutive loose-leaf paper pages at the same time.

The objective of the present invention is realized as follows. A loose-leaf folder device is applied. The loose-leaf folder device includes a pair of main components (A). Each main component (A) comprises a housing (1), and one or more first half retaining rings (2) are arranged thereon. Two main components (A) can be combined with or separated from each other. When two main components (A) are combined with each other, each first half retaining ring (2) of one main component (A) can be combined with a corresponding first half retaining ring (2) of the other main component (A) to form a closed retaining ring, so that loose-leaf paper (B), which is retained by the first half retaining ring (2) located at one main component (A), can be moved along the closed retaining ring to the other main component (A); and when two main components (A) are separated from each other, the main component (A) along with loose-leaf paper (B) retained by it can be separated from the other main component (A) to form two independent parts.

To better achieve the objective of the present invention, second half retaining rings (3) and storage spaces (5), which respectively have the same number as the first half retaining rings (2), are arranged on the side combined with the other main component of the housing (1). Each second half retaining ring (3) and one storage space (5) are corresponding to one first half retaining ring (2). The second half retaining rings (3) and the storage spaces (5) are located at two sides of the first half retaining rings (2). When a main component (A) is not combined with other main component (A) but is in independent state, the second half retaining rings (3) can rotate on the housing (1) to form a first state and a second state with the corresponding first half retaining rings (2). Under the first state, the second half retaining ring (3) is combined with the corresponding first half retaining ring (2) to form a closed retaining ring to retain loose-leaf paper (B); under the second state, the second half retaining ring (3) is staggered with the corresponding first half retaining ring (2) to form an open retaining ring, so that loose-leaf paper (B) can be drawn out from and put into the main component (A) from the opening. When two main components (A) are combined with each other, the second half retaining rings (3) on the two main components (A) are under the second state, and the storage spaces (5) receive the protruded portions of the corresponding second half retaining rings (3) on the other main component (A).

To achieve the objective of the present invention, another loose-leaf folder device can also be applied. The loose-leaf folder device comprises a main component (A). The main component (A) comprises a housing (1), and one or more first half retaining rings (2) are arranged thereon. Second half retaining rings (3) and storage spaces (5) are arranged, which respectively have the same number as the first half retaining rings (2). Each second half retaining ring (3) is corresponding to one first half retaining ring (2) and one storage space (5); the second half retaining rings (3) can rotate on the housing (1) to form a first state and a second state with the first half retaining rings (2). Under the first state, the second half retaining ring (3) is combined with the corresponding first half retaining ring (2) to form a closed retaining ring to retain loose-leaf paper (B); under the second state, the second half retaining ring (3) is staggered with the corresponding first half retaining ring (2) to form an open retaining ring, so that loose-leaf paper (B) can be drawn out from and put into the main component (A) from the openings.

Besides, the main components (A) are used in pairs. When all second half retaining rings (3) of two main components (A) are under the second state, the two main components (A) can be combined with each other. When two main components (A) are combined with each other, the storage spaces (5) receive the protruded portion of the corresponding second half retaining rings (3) on the other main component (A). The two main components (A) can be combined with each other only through the storage spaces (5). Each first half retaining ring (2) on one main component (A) can be combined with the opposite first half retaining ring (2) on the other main component (A) to form a closed retaining ring, so that the loose-leaf paper (B), which is retained by the first half retaining ring (2) located at one main component (A), can be moved along the closed retaining ring to the other main component (A).

The loose-leaf folder device disclosed in this invention has separation and recombination function, i.e., two main components (A) can be combined with and separated from each other. When two main components (A) are combined together, a device is formed, which is similar to a common loose-leaf folder device. The holes of loose-leaf paper (B) are retained by the first half retaining rings (2) of main components (A) and loose-leaf paper (B) on this device is turned over. When two main components (A) are separated from each other, two independent parts are formed and loose-leaf paper (B) on this device is separated into two parts. Then rotating the second half retaining ring (3) on a main components (A) to form a closed retaining ring with the first half retaining ring (2) to retain loose-leaf paper (B) on the main components (A). Loose-leaf paper (B) on each main component (A) can be turned over independently, which makes users conveniently review and compare different loose-leaf paper (B) pages of two main components (A) at the same time.

As such, the objective of the present invention can be achieved very well.

The loose-leaf folder device provided in this invention has simple and novel structure. Through its separation and recombination function, when a user needs to review and compare different loose-leaf paper pages at the same time, the user needs not to draw out loose-leaf paper from the loose-leaf folder and insert loose-leaf paper into the loose-leaf folder. The user can separate the loose-leaf folder device into two independent folders, which allows the user to conveniently review and compare different loose-leaf paper (B) pages at the same time. After reviewing and comparing, the two independent parts can be recombined with each other to be a whole loose-leaf folder device. As such, the order of the loose-leaf paper is maintained, so as to avoid tearing holes of loose-leaf paper when inserting loose-leaf paper back into the loose-leaf folder.

BRIEF DESCRIPTION OF THE DRAWINGS

In the drawings, the same numeral represents the same device or the same part device. The drawings are illustrative for explaining the structures and main features of the present invention.

DETAILED DESCRIPTION

The method of the present invention will be described in detail as follows in combination with accompany drawings.

Figure 1:
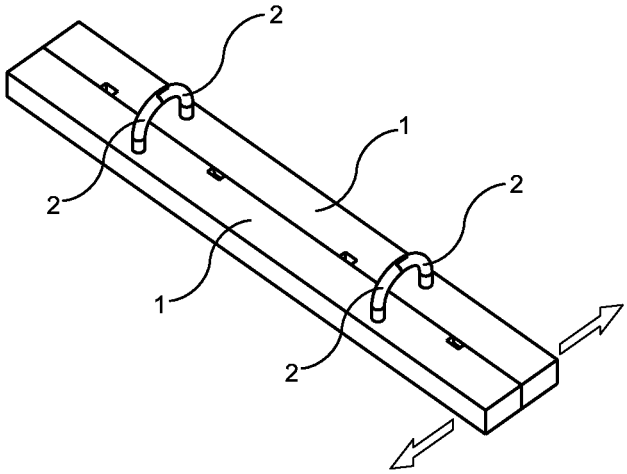
FIG. 1 is a visual schematic diagram of a loose-leaf folder device according to the first embodiment of the present invention.
Figure 2:
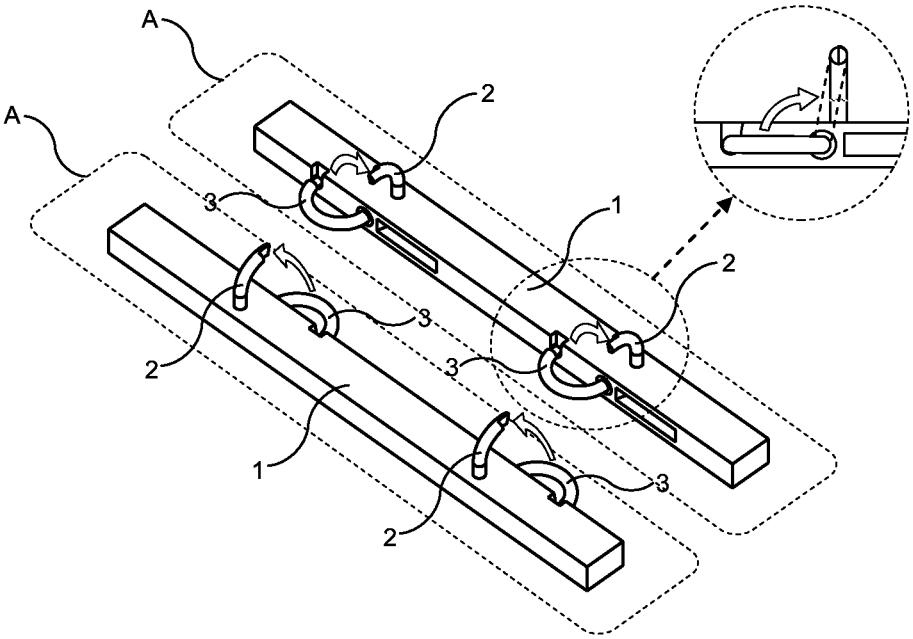
FIG. 2 is a visual schematic diagram of two main components (A) of the loose-leaf folder device separated from each other according to the first embodiment of the present invention.
Figure 3:
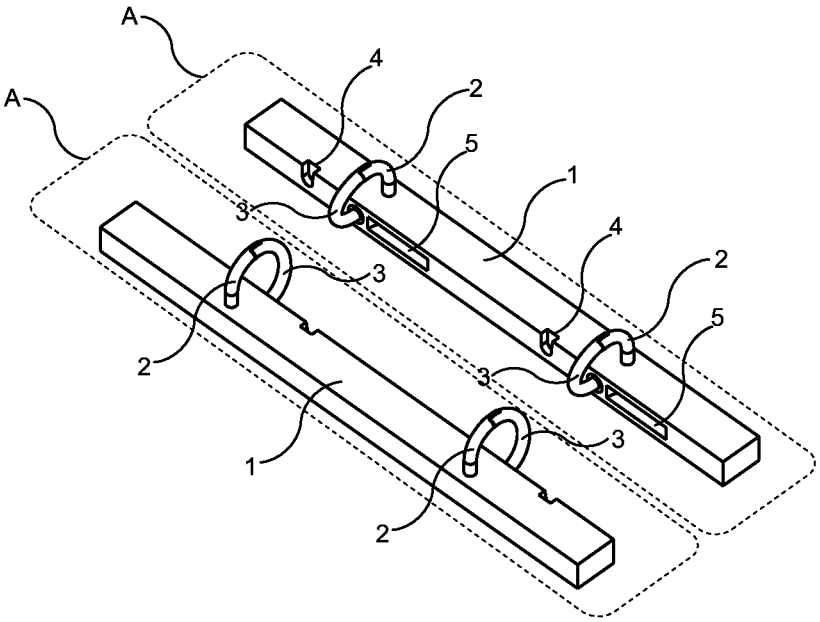
FIG. 3 is a visual schematic diagram of second half retaining rings (3) of the loose-leaf folder device being combined with the corresponding first half retaining rings (2) to form closed retaining rings according to the first embodiment of the present invention.

Referring to FIGS. 1-3, FIG. 1 is a visual schematic diagram of a loose-leaf folder device according to the first embodiment of the present invention, FIG. 2 is a visual schematic diagram of two main components (A) of the loose-leaf folder device separated from each other according to the first embodiment of the present invention, and FIG. 3 is a visual schematic diagram of a second half retaining ring (3) of the loose-leaf folder device being combined with the corresponding first half retaining ring (2) to form a closed retaining ring according to the first embodiment of the present invention. The loose-leaf folder device illustrated in FIGS. 1-3 comprises a pair of main components (A). Each main component (A) comprises a housing (1), and one or more first half retaining rings (2) are arranged thereon. Two main components (A) can be combined with each other or separated from each other. When two main components (A) are combined with each other, each first half retaining ring (2) of one main component (A) can be combined with the corresponding first half retaining ring (2) of the other main component (A) to form a closed retaining ring, so that loose-leaf paper (B), which is retained by the first half retaining ring (2) located at one main component (A), can be moved along the closed retaining ring to the other main component (A); and when two main components (A) are separated from each other, the main component (A) along with the loose-leaf paper (B) retained by itself can be separated from the other main component (A) to form two independent parts.

Still referring to FIGS. 2 and 3, on the side (referred to as "combination side") of the housing (1) of the main component (A) of the first embodiment illustrated in FIGS. 2 and 3 combined with the other main component, a second half retaining ring (3) is arranged, which number is the same number as that of the first half retaining ring (2). The arranged position of each second half retaining ring (3) is corresponding to a first half retaining ring (2). The external shape of a second half retaining ring (3) is substantively a semicircle ring, wherein one end is connected to the combination side and the other end is a free end, which can rotate around the connected end. When a main component (A) is not combined with the other main component (A) but in an independent state, the second half retaining ring (3) can rotate on the housing (1) and forms a first and a second states with the corresponding first half retaining ring (2). As illustrated in the dotted circle on the upper right of FIG. 2, the second half retaining ring (3) can rotate to a horizontal state, which is at right angles to the first half retaining ring (2), i.e., the second state; the second half retaining ring (3) can rotate along the arrow direction in FIG. 2 to combine with the first half retaining ring (2) to form a closed state, i.e., the first state, i.e., the state shown in FIG. 3. Under the first state, the second half retaining ring (3) is combined with the corresponding first half retaining ring (2) to form a closed retaining ring to retain loose-leaf paper (B); under the second state, the second half retaining ring (3) is staggered with the corresponding first half retaining ring (2) to form an open retaining ring, so that loose-leaf paper (B) can be drawn out from and put into the main component (A) from the opening. In addition, when the second half retaining ring (3) rotates on the housing (1), it can rotates from the position corresponding to "the first state" to the position corresponding to "the second state," or from the position corresponding to "the second state" to the position corresponding to "the first state." The second half retaining ring (3) should keep in the position corresponding to "the first state" or the position corresponding to "the second state" but should not stay at the position between "the first state" and "the second state." This requires the housing (1) to be added some limit mechanical structures to limit the rotation angle of the second half retaining ring (3), for example, adding mechanical structures such as spring, steel sheet, etc. The second half retaining ring (3) between the positions of "the first state" and "the second state" is pushed to the position of "the first state" or the position of "the second state," preventing it from staying at the position between "the first state" and "the second state." These limit mechanical structures can be implemented by similar mechanical structures in the retaining ring opening and closing structure of existing common loose-leaf folder. Since this is conventional art and not main concept of the present invention, detail description about this is omitted in the specification and drawings.

Still referring to FIGS. 1-3, recesses (4), which number is the same as that of the first half retaining rings (2), are arranged on the combination side of the housing (1) shown in the first embodiment of FIGS. 1-3. When the second half retaining rings (3) are in the second state, the recesses (4) opposite to the second half retaining rings (3) are used to receive the top portions of the second half retaining rings (3), so that the second half retaining rings (3) can rotate to the position with a 90 degree angle to the corresponding first half retaining rings (2), and the second half retaining rings (3) will not protrude to influence loose-leaf paper (B) on the main component (A). It should be noted that opposite recesses (4) in a pair of main components (A) should be notched at different sides of corresponding first half retaining rings (2). As illustrated in FIG. 3, recesses (4) of the left main component (A) are notched at the downside of the first half retaining rings (2), and recesses (4) of the right main component (A) is notched at the upside of the first half retaining rings (2). Furthermore, storage spaces (5), which number is the same number as that of the first half retaining rings (2), are arranged on the combination side of the housing (1). The storage spaces (5) are located at one side of the second half retaining rings (3), which is different from the side of recesses (4). That is, storage spaces (5) and recesses (4), which are corresponding to the first half retaining rings (2) respectively, are located at opposite sides of the first half retaining rings (2). When the two main components (A) combined with each other, the first half retaining rings (2) and the second half retaining rings (3) must be in the second state. The storage spaces (5) are used to receive the protruded portions of the corresponding second half retaining rings (3) on the other main component (A). The two main components (A) can be combined with each other through the storage spaces (5).

In this invention, the number of the first half retaining rings (2) on the main component (A) can be any number of one or more than one. For example, each main component (A) only has one first half retaining ring (2); for another example, each main component (A) has two, three, four, five, or six first half retaining rings (2). The number of first half retaining ring (2) can be determined by the number of holes of the loose-leaf paper (B). No matter how many first half retaining rings (2) are applied, the objective of the present invention can be realized very well, which is within the scope of this disclosure.

The further improvement in this invention is that a linkage mechanism is arranged in the chamber of the housing (1). All second half retaining rings (3) of the same housing (1) are connected by the linkage mechanism, so all the second half retaining rings (3) rotate synchronously, and the linkage mechanism can be achieved by existing mechanical technologies, such as wheel gears, connecting rods, etc.

Figure 4:
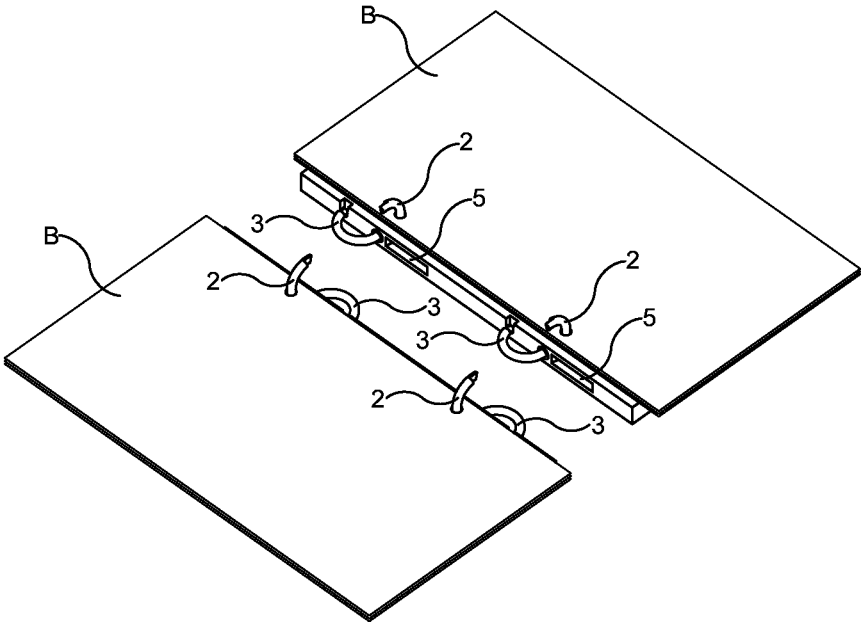
FIG. 4 is a visual schematic diagram of the loose-leaf folder device retaining loose-leaf paper (B) according to the first embodiment of the present invention.

Referring to FIG. 4, FIG. 4 is a visual schematic diagram of the loose-leaf folder device retaining loose-leaf paper (B) according to the first embodiment of the present invention. FIG. 4 shows that, if two main components (A) in the first embodiment are separated from each other to form two independent parts, the loose-leaf paper (B) is separated to two parts. The loose-leaf paper (B) can be drawn out from or inserted into each part. Furthermore, the second half retaining ring (3) can rotate to combine with the corresponding first half retaining ring (2) to form a closed retaining ring to retain the loose-leaf paper (B). As such, two independent loose-leaf folder devices are formed and users can simultaneously review and compare different pages of loose-leaf paper (B) of two main components (A).

Figure 5:
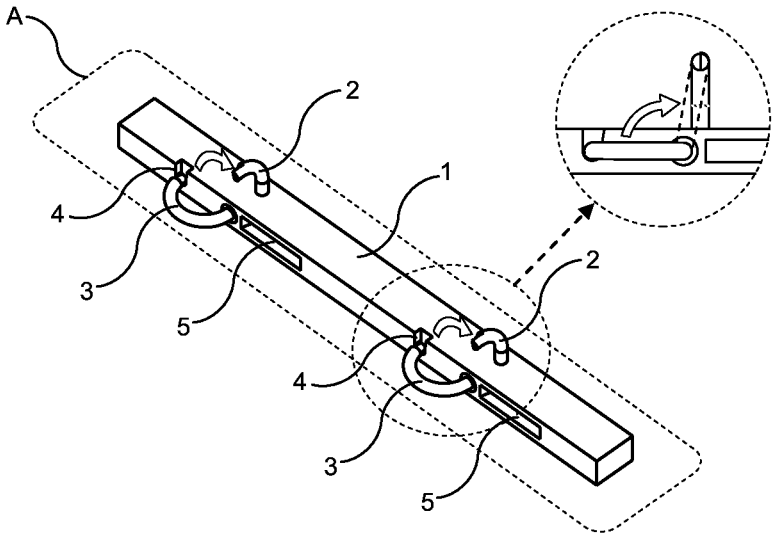
FIG. 5 is a visual schematic diagram of a loose-leaf folder device according to the second embodiment of the present invention.

Referring to FIG. 5, FIG. 5 is a visual schematic diagram of a loose-leaf folder device according to the second embodiment of the present invention. Comparing the second embodiment shown in FIG. 5 with the first embodiment, the difference is that the first embodiment is described with a pair of main components (A) as a set of devices, but the second embodiment is described with a single main component (A). Any main component (A) in the first embodiment has substantively the same structure as that of the main component (A) in the second embodiment. Still referring to FIG. 5, the loose-leaf folder device shown in FIG. 5 only comprises one main component (A). The main component (A) comprise a housing (1), and one or more first half retaining rings (2) are arranged thereon. The second half retaining rings (3) and the storage spaces (5), which respectively have the same number as the first half retaining rings (2), are arranged on the side opposite to the openings of the first half retaining rings (2). Each second half retaining ring (3) is corresponding to one first half retaining ring (2) and one storage space (5). The second half retaining ring (3) can rotate on the housing (1) to form a first state and a second state with the corresponding first half retaining ring (2). Under the first state, the second half retaining ring (3) is combined with the corresponding first half retaining ring (2) to form a closed retaining ring to retain loose-leaf paper (B); under the second state, the second half retaining ring (3) is staggered with the corresponding first half retaining ring (2) to form an open retaining ring, so that loose-leaf paper (B) can be drawn out from and put into the main component (A) from the opening. The main components (A) in FIG. 5 perhaps are used in pairs. When all second half retaining rings (3) of two main components (A) are under the second state, the two main components (A) can be combined with each other. When two main components (A) are combined with each other, the storage space (5) receives the protruded portion of the corresponding second half retaining ring (3) on the other main component (A). The two main components (A) can be combined with each other only through the storage spaces (5). Each first half retaining ring (2) on one main component (A) can be combined with the opposite first half retaining ring (2) on the other main component (A) to form a closed retaining ring, so that the loose-leaf paper (B), which is retained by the first half retaining ring (2) located at one main component (A), can be moved along the closed retaining ring to the other main component (A). In addition, recesses (4), which number is the same as that of the first half retaining ring (2), are arranged on the housing (1) of the main component (A) in the second embodiment. The recess (4) is the same as the recess (4) described in the aforementioned first embodiment and need not be repeated here.

Figure 6:
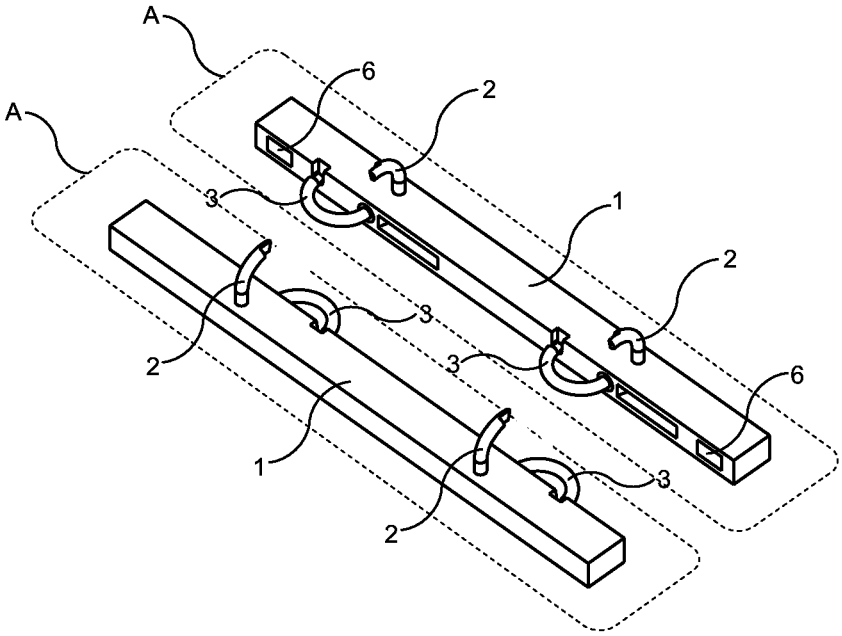
FIG. 6 is a visual schematic diagram of a loose-leaf folder device using magnet (6) to keep combination of main components (A) according to the third embodiment of the present invention.
Figure 7:
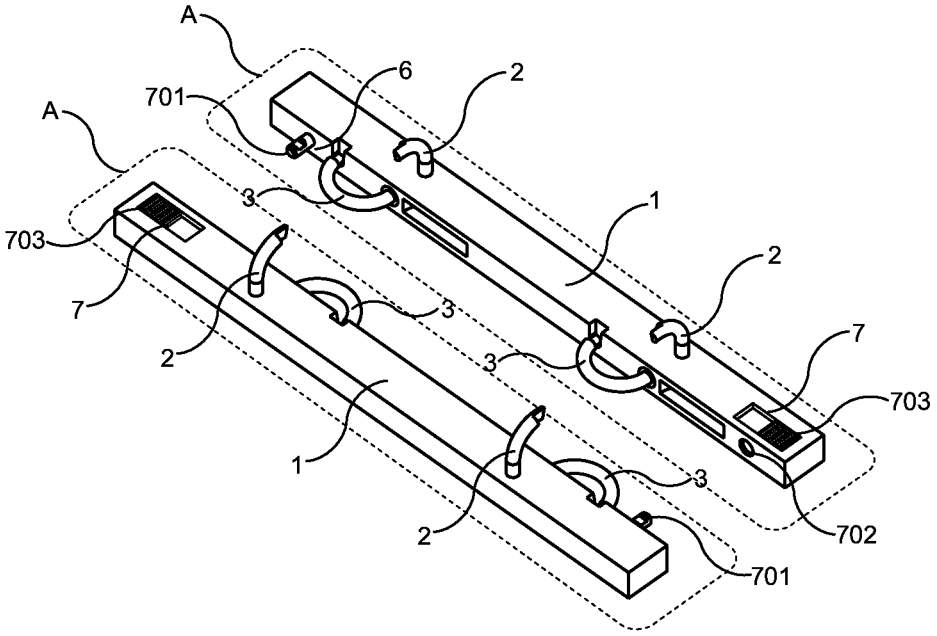
FIG. 7 is a visual schematic diagram of a loose-leaf folder device using a splice locking device (7) to keep combination of main components (A) according to the fourth embodiment of the present invention.

Referring to FIGS. 6 and 7, FIG. 6 is a visual schematic diagram of a loose-leaf folder device using a magnet (6) to keep combination of main components (A) according to the third embodiment of the present invention. FIG. 7 is a visual schematic diagram of a loose-leaf folder device using a splice locking device (7) to keep combination of main components (A) according to the fourth embodiment of the present invention. The third and the fourth embodiments in FIGS. 6 and 7 respectively show different examples about how to keep main components (A) in combination state when the loose-leaf folder device is in combination state. The technical measures taken in this invention belong to existing technologies, and these existing technologies are not main concept of the present invention. That is, they are not essential technical features of the present invention. Therefore, these contents are omitted in the aforementioned first and second embodiments shown in FIG. 1 and FIG. 5. In addition, other existing technologies can also be applied to realize keeping two main components (A) in combination state. No matter what way is applied, e.g., the way of the third embodiment or the fourth embodiment or other ways, these ways can achieve keeping two main components (A) in combination state very well.

Still refereeing to FIG. 6, in the third embodiment shown FIG. 6, a magnet (6) is arranged on the housing (1). When two main components (A) are combined with each other, two main components (A) maintain in combination state by magnetic attraction generated by the magnet (6). As illustrated in FIG. 6, each main component (A) has two magnets (6), which are located on the side used to be combined with the other main component (A). The two magnets (6) are arranged with different poles, for example, the south pole of the left magnet (6) points outwards, while the north pole of the right magnet (6) points outwards. As such, when two main components (A) are combined with each other, the two main components (A) can maintain in combination state by magnetic attraction generated by magnets (6).

Continued to referring to FIG. 7, in the fourth embodiment shown in FIG. 7, the housing (1) has a splice locking device (7). When two main components (A) are combined with each other, the splice locking device (7) makes the two main components (A) maintain in combination state. The splice locking device (7) comprises a locating pin (701), a locating hole (702), a lockpin device (703), wherein the locating pin (701) on a main component (A) is plugged into the locating hole (702) of the other main component (A), and the lockpin device (703) can tighten or loosen the locating pin (701) of the other main component (A) in the locating hole (702). As such, two main components (A) can maintain a combination state or a separation state.

Figure 8:
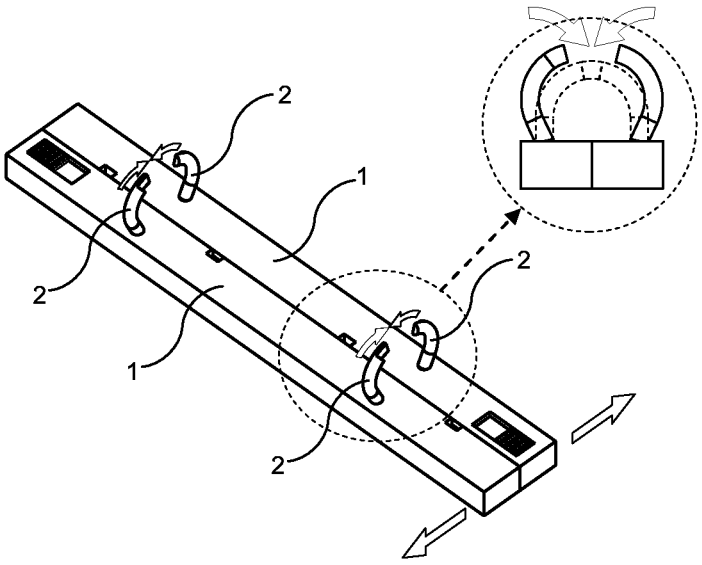
FIG. 8 is a visual schematic diagram of a loose-leaf folder device according to the fifth embodiment of the present invention.

Referring to FIG. 8, FIG. 8 is a visual schematic diagram of a loose-leaf folder device according to the fifth embodiment of the present invention. The fifth embodiment shown in FIG. 8 is a further improvement to this invention. When a pair of main components (A) are combined with each other, the first half retaining ring (2) on the housing (1) can open and close toward two sides to form an open retaining ring or a closed retaining ring, so that loose-leaf paper (B) can be drawn out when the loose-leaf folder device of the present invention is in combination state. As illustrated in the dotted circle in the upper right of FIG. 8, each first half retaining ring (2) on a main component (A) can rotate to open and close, to form a open retaining ring or a closed retaining ring with a corresponding first half retaining ring (2) on the other main component (A). Loose-leaf paper (B) can be retained when all corresponding first half retaining rings (2) of the two main components (A) form closed retaining rings, and loose-leaf paper (B) can be drawn from the loose-leaf folder device when all opposite first half retaining rings (2) of the two main components (A) form open retaining rings. In addition, the mechanism, which is used by the first half retaining rings (2) to open and close, also needs structures similar to the above limit mechanical structures of the second half retaining rings (3). Mechanical structures, such as spring, steel sheet, etc., are used to limit the first half retaining rings (2) to one position of "open" or "closed." This is similar to the mechanical structures of the retaining ring opening and closing mechanism in existing common loose-leaf folder. Since they belong to existing technologies and are not main concept of the present invention, detail descriptions are omitted in the specification and drawings.

According to the loose-leaf folder device with separation and recombination function provided in this disclosure, users can separate the loose-leaf folder into two independent folders to review and compare contents of different loose-leaf paper (B), and users thus can experience unprecedented flexibility and convenience.

The loose-leaf folder device with separation and recombination function of the present invention has been described above in detail. Although illustrated by the above embodiments, the present invention is not limited to this. Within the sprit of the present application and the scope of appended claims, various changes and alternative can be applied to this application.

What is claimed is:

1. A loose-leaf folder device, comprising:

a pair of main components; each main component comprises a housing, one or more first half retaining rings, and second half retaining rings, which are of the same number as the first half retaining rings, are arranged thereon; the two main components can be combined with or separated from each other; when the two main components are combined with each other, each first half retaining ring of one main component can be combined with a corresponding first half retaining ring of the other main component to form a closed retaining ring; and when the two main components are separated from each other, a main component can be separated from the other main component to form two independent parts, where each main component has independent closed retaining rings formed by the combination of each of the first half retaining rings and a corresponding one of the second half retaining rings.

2. The loose-leaf folder device according to claim 1, further comprising storage spaces, which are of the same number as the first half retaining rings; the second half retaining rings and the storage spaces are arranged on the side combined with the other main component of the housing, wherein each of the second half retaining rings and storage spaces correspond to one of the first half retaining rings, wherein, when the main component is not combined with the other main component, the second half retaining ring can rotate on the housing to form a first state and a second state with the corresponding first half retaining ring, wherein, under the first state, the second half retaining ring is combined with the corresponding first half retaining ring to form a closed retaining ring, wherein, under the second state, the second half retaining ring is staggered with the corresponding first half retaining ring to form an open retaining ring, and wherein, when two main components are combined with each other, the second half retaining rings on the two main components are under the second state, and the storage spaces are configured to receive protruded portions of the corresponding second half retaining rings on the other main component.

3. The loose-leaf folder device according to claim 2, further comprising recesses, which number is the same as that of the first half retaining rings, arranged on the combination side of the housing, wherein, when the second half retaining rings are under the second state, the recesses corresponding to the second half retaining rings are configured to receive top portions of the second half retaining rings.

4. The loose-leaf folder device according claim 2, further comprising a magnet arranged on the housing, wherein, when two main components are combined with each other, the two main components keep in combination state by magnetic attraction generated by the magnet.

5. The loose-leaf folder device according to claim 2, further comprising a splice locking device arranged on the housing, wherein, when two main components are combined with each other, the splice locking device makes the two main components keep in combination state.

6. The loose-leaf folder device according to claim 2, wherein the first half retaining rings can open and close on the housing, and wherein, when a pair of main components are combined with each other, corresponding first half retaining rings can form an open retaining ring or a closed retaining ring.

7. The loose-leaf folder device according claim 3, further comprising a magnet arranged on the housing, wherein, when two main components are combined with each other, the two main components keep in combination state by magnetic attraction generated by the magnet.

8. The loose-leaf folder device according to claim 3, further comprising a splice locking device arranged on the housing, wherein, when two main components are combined with each other, the splice locking device makes the two main components keep in combination state.

9. The loose-leaf folder device according to claim 3, wherein the first half retaining rings can open and close on the housing, and wherein, when a pair of main components are combined with each other, corresponding first half retaining rings can form an open retaining ring or a closed retaining ring.

10. The loose-leaf folder device according to claim 1, further comprising a magnet arranged on the housing, wherein, when two main components are combined with each other, the two main components keep in combination state by magnetic attraction generated by the magnet.

11. The loose-leaf folder device according to claim 1, further comprising a splice locking device arranged on the housing, wherein, when two main components are combined with each other, the splice locking device makes the two main components keep in combination state.

12. The loose-leaf folder device according to claim 1, wherein the first half retaining rings can open and close on the housing, and wherein, when a pair of main components are combined with each other, corresponding first half retaining rings can form an open retaining ring or a closed retaining ring.

13. A loose-leaf folder device comprising:

a main component; the main component including:

a housing, and one or more first half retaining rings arranged thereon; and second half retaining rings and storage spaces, which respectively have the same number as the first half retaining rings, arranged on a side of the housing adjacent to the first half retaining rings, wherein each second half retaining ring is corresponding to one first half retaining ring and one storage space, wherein the second half retaining ring can rotate on the housing to form a first state and a second state with the corresponding first half retaining ring, wherein, under the first state, the second half retaining ring is combined with the corresponding first half retaining ring to form a closed retaining ring, wherein, under the second state, the second half retaining ring is staggered with the corresponding first half retaining ring to form an open retaining ring, wherein when two main components are combined with each other, the storage space receives a protruded portion of the corresponding half retaining ring on the other main component, and wherein each first half retaining ring on a main component can be combined with the opposite first half retaining ring on the other main component to form a closed retaining ring.

14. The loose-leaf folder device according to claim 13, further comprising recesses, which number is the same as that of the first half retaining rings, arranged on a side of the housing adjacent to the first half retaining rings of the housing, wherein, when the second half retaining rings are under the second state, the recesses corresponding to the second half retaining rings are configured to receive top portions of the second half retaining rings.

15. The loose-leaf folder device according to claim 14, wherein the first half retaining rings can open and close on the housing, and wherein, when a pair of main components are combined with each other, the corresponding first half retaining rings can form an open retaining ring or a closed retaining ring.

16. The loose-leaf folder device according to claim 13, further comprising a magnet arranged on the housing, wherein, when two main components are combined with each other, the two main components keep in combination state by magnetic attraction generated by the magnet.

17. The loose-leaf folder device according to claim 16, wherein the first half retaining rings can open and close on the housing, and wherein, when a pair of main components are combined with each other, the corresponding first half retaining rings can form an open retaining ring or a closed retaining ring.

18. The loose-leaf folder device according to claim 13, further comprising a splice locking device arranged on the housing, wherein, when two main components are combined with each other, the splice locking device makes the two main components keep in combination state.

19. The loose-leaf folder device according to claim 18, wherein the first half retaining rings can open and close on the housing, and wherein, when a pair of main components are combined with each other, the corresponding first half retaining rings can form an open retaining ring or a closed retaining ring.

20. The loose-leaf folder device according to claim 13, wherein the first half retaining rings can open and close on the housing, and wherein, when a pair of main components are combined with each other, the corresponding first half retaining rings can form an open retaining ring or a closed retaining ring.

* * * * *